US006715761B1

(12) United States Patent
Moberg

(10) Patent No.: US 6,715,761 B1
(45) Date of Patent: Apr. 6, 2004

(54) APPARATUS FOR SHOOTING RANGES

(76) Inventor: Gerth Moberg, P.O. Box Helganas, 59098, Edsbruk (SE)

( * ) Notice: Subject to any disclaimer, the term of this patent is extended or adjusted under 35 U.S.C. 154(b) by 0 days.

(21) Appl. No.: 10/249,091

(22) Filed: Mar. 14, 2003

(51) Int. Cl.[7] ..... F91J 1/12
(52) U.S. Cl. ..... 273/410
(58) Field of Search ..... 273/403, 404, 273/407, 408, 410; 89/36.02

(56) References Cited

U.S. PATENT DOCUMENTS

| | | | | |
|---|---|---|---|---|
| 4,728,109 A | | 3/1988 | Simonetti | |
| 4,786,059 A | * | 11/1988 | Barini | 273/410 |
| 4,919,437 A | * | 4/1990 | Salabe et al. | 273/410 |
| 5,441,280 A | * | 8/1995 | Copius | 273/410 |
| 5,799,948 A | * | 9/1998 | Moberg | 273/410 |
| 5,848,794 A | | 12/1998 | Wojcinski | |
| 5,901,960 A | | 5/1999 | Nesler | |
| 5,907,930 A | * | 6/1999 | Ricco, Sr. | 52/79.1 |
| 6,173,956 B1 | * | 1/2001 | O'Neal | 273/410 |
| 6,378,870 B1 | * | 4/2002 | Sovine | 273/410 |
| 6,533,280 B1 | * | 3/2003 | Sovine et al. | 273/410 |

FOREIGN PATENT DOCUMENTS

| | | | |
|---|---|---|---|
| EP | 399960 | * | 5/1990 |
| EP | 0 683 375 A1 | | 11/1995 |

* cited by examiner

*Primary Examiner*—Mark S. Graham
(74) *Attorney, Agent, or Firm*—Rolf Fasth; Fasth Law Offices

(57) ABSTRACT

The apparatus is for installation at shooting ranges and has a housing that has a resilient top layer and a bottom support surface. The bottom support surface has a movable cleaning arrangement that may move the granulate material and projectiles in a channel. The bottom layer supports the granulate material at an angle that is steeper than the angle of repose of the granulate material.

13 Claims, 9 Drawing Sheets

FIG. 7
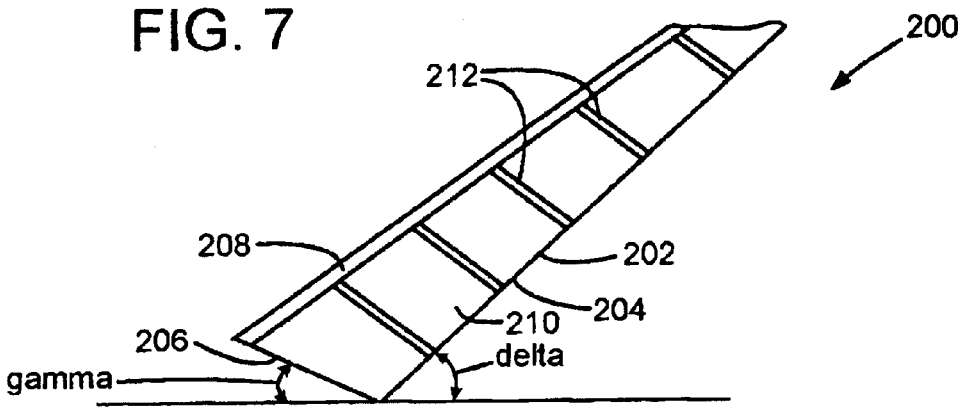
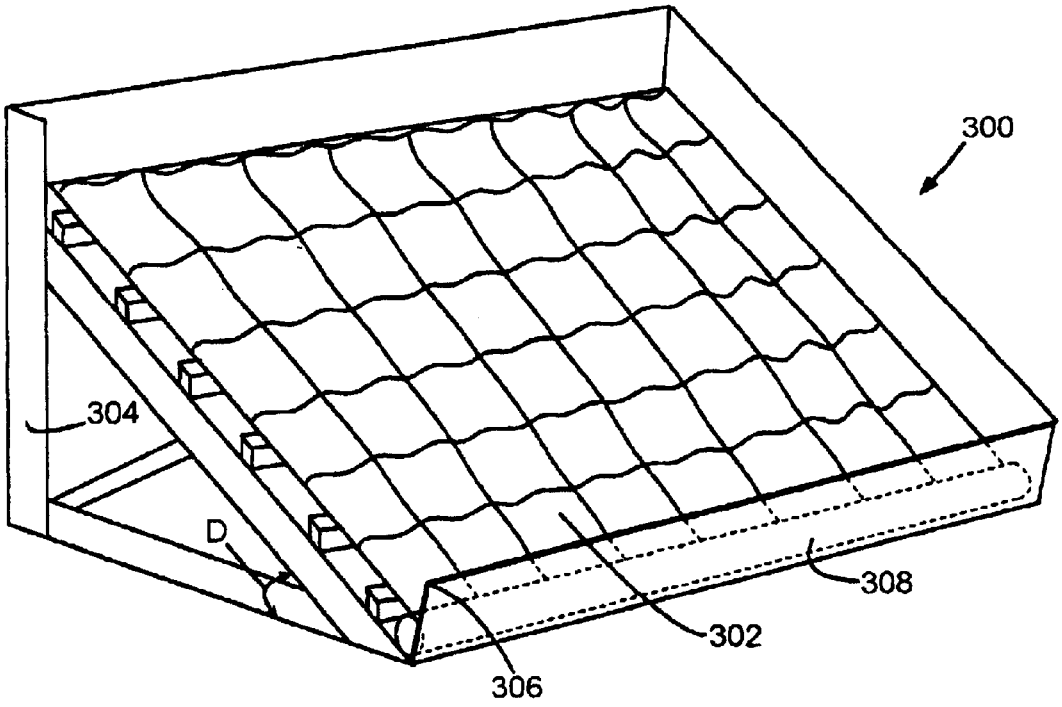
FIG. 8

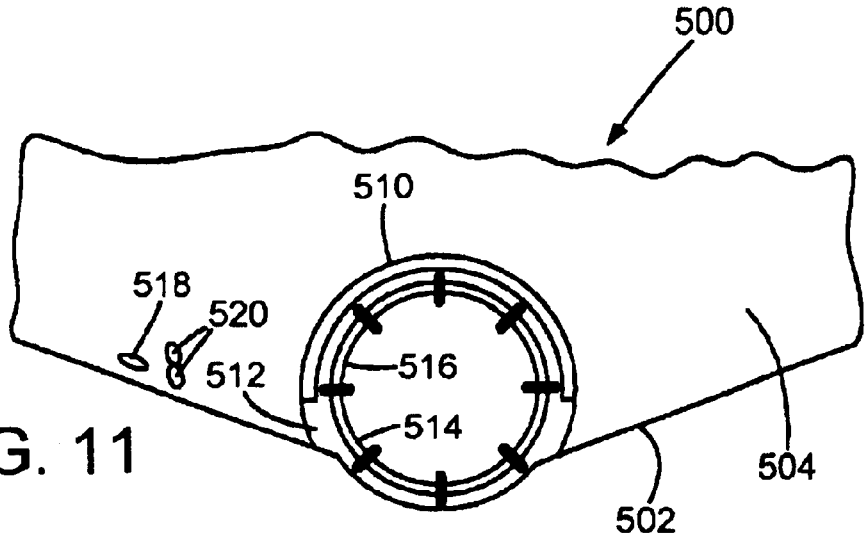
FIG. 11
FIG. 12
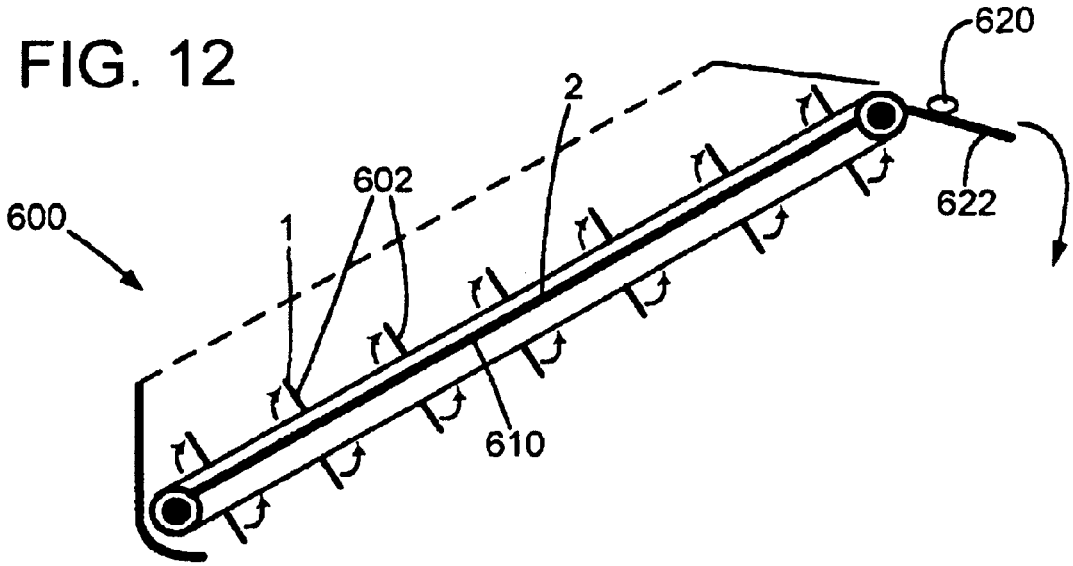

APPARATUS FOR SHOOTING RANGES

BACKGROUND OF INVENTION

The present invention relates to an apparatus for installation at shooting ranges that supports a granulate material at an angle that is steeper than the angle of repose of the granulate material.

Most bullets and other projectiles are fully or partly made of lead or other contaminating materials. This leads to an environmental problem at shooting ranges when the bullets are captured by sandbanks and other inclined surfaces positioned behind the targets. Large amounts of lead and lead compounds leach into the ground or get airborne in an uncontrolled manner. There is a need for an apparatus that effectively and safely captures lead and other bullets without polluting the environment.

SUMMARY OF INVENTION

The present invention provides a solution to the above-outlined problems. More particularly, the apparatus of the present invention is for installation at shooting ranges. The apparatus has a housing that has a resilient top layer and a bottom layer. The bottom layer has a movable cleaning arrangement that may move the granulate material in a channel. The bottom layer supports the granulate material at an angle that is steeper than the angle of repose of the granulate material.

BRIEF DESCRIPTION OF DRAWINGS

FIG. 7 is a side view of a third embodiment of the apparatus of the present invention;

FIG. 8 is a perspective side view of a fourth alternative embodiment of the present invention;

FIG. 11 is a cross-sectional view of the valve system shown in FIG. 10;

FIG. 12 is a detailed side view of a belt system of the present invention;

DETAILED DESCRIPTION

Figure 1:
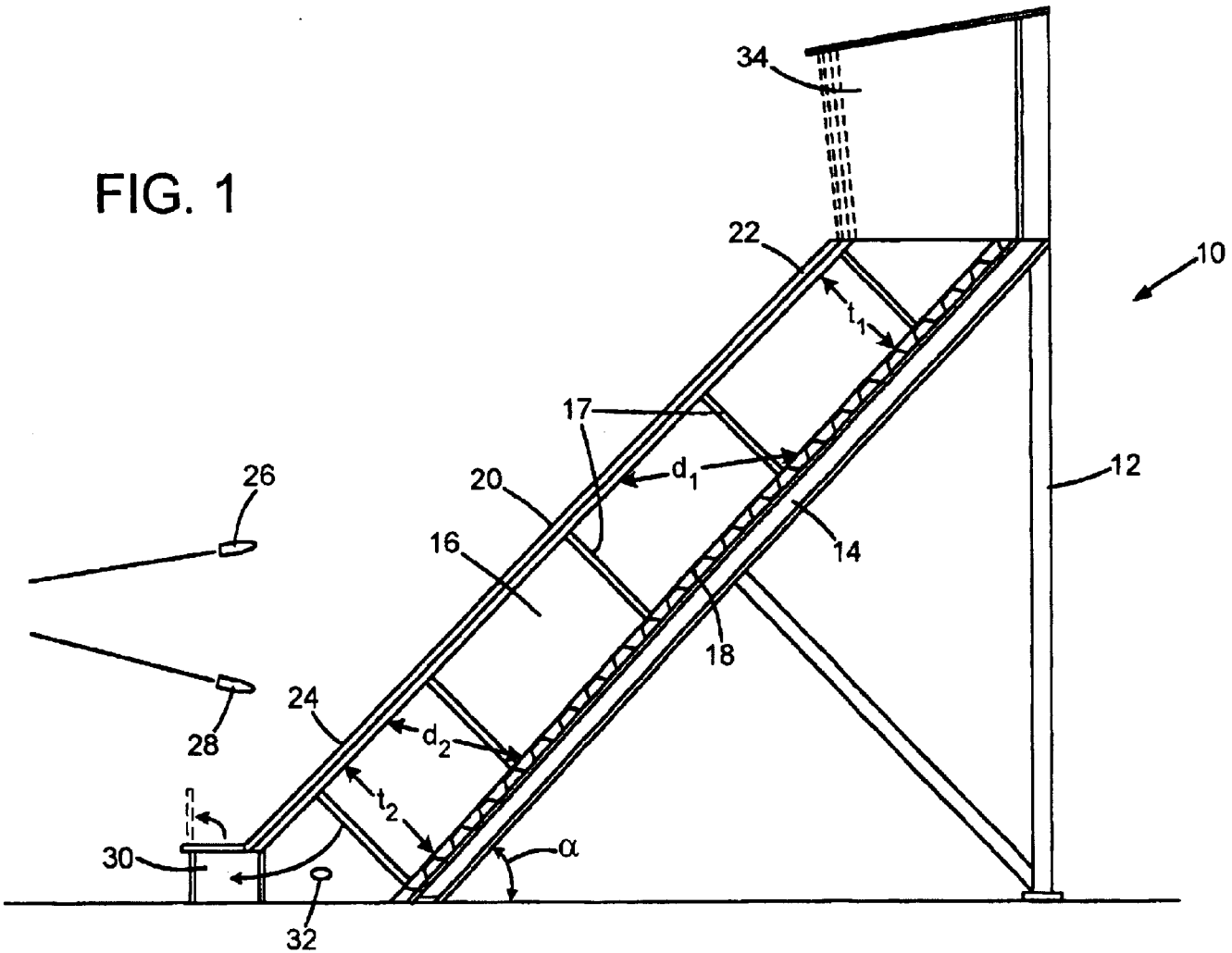
FIG. 1 is a side view of a first embodiment of the shooting range apparatus of the present invention.

With reference to FIG. 1, the shooting range apparatus 10 of the present invention has a support structure 12 that supports a sloping surface 14. A free flowing granulate material 16 is supported by an under-layer 18, such as corrugated sheet metal or conventional sheet metal or any other suitable material, disposed on the surface 14 at an angle alpha that is greater than the angle of repose of the granulate material 16. The angle of repose may mean the equilibrium angle of the granulated material 16 at which the granulate material 16 may start to flow due to the gravitational forces overtaking the frictional forces between the granulate particles and the frictional forces between the granulate material and the supporting surface. In other words, the angle of repose may be the angle from the horizontal that the granulated material 16 assumes when at rest, from the top of the pile to its base. The angle of repose may be greater than the angle of slide that may mean the angle to the horizontal at which the granulate material 16 will begin to slide on a smooth, flat surface, by its own weight.

A top layer 20 is placed on top of granulate material 16 and is held to the support structure 12 by reinforced bands 17 such as nylon reinforced rubber bands or any other type of elongate member. Because the angle alpha is greater than the angle of repose of the material 16, it is important to hold the layer 20 due to the pressure exerted thereon by the material 16. The material 16 may have a thickness t1 at an upper end 22 of the top layer 20 and a thickness t2 at a lower end 24 of the top layer 20. The thickness t1 is preferably less than the thickness t2 because a projectile 26 penetrate the top layer 20 at the upper end 22 at an angle so that the projectile 26 must penetrate a distance d1 before encountering the under layer 18. In comparison a projectile 28 that penetrates the layer 20 at the lower end 24 must travel a distance d2 before encountering the under layer 18. Although the thickness t1 is less than the thickness t2, the distance d1 is greater than the distance d2 due to the angle differences so it is acceptable to use a thinner thickness t1 at the upper end 22. Of course, the upper end 22 and the lower end 24 may have the same thickness, if desired.

The apparatus 10 may have a manual emptying box 30 disposed at the lower end 24 to empty out a portion of the granulate material 16 and projectiles 32 that has been received by the granulate material 16. The apparatus 10 may also have a filling box 34 for filling the apparatus 10 with granulate material 16 as needed.

Figure 2:
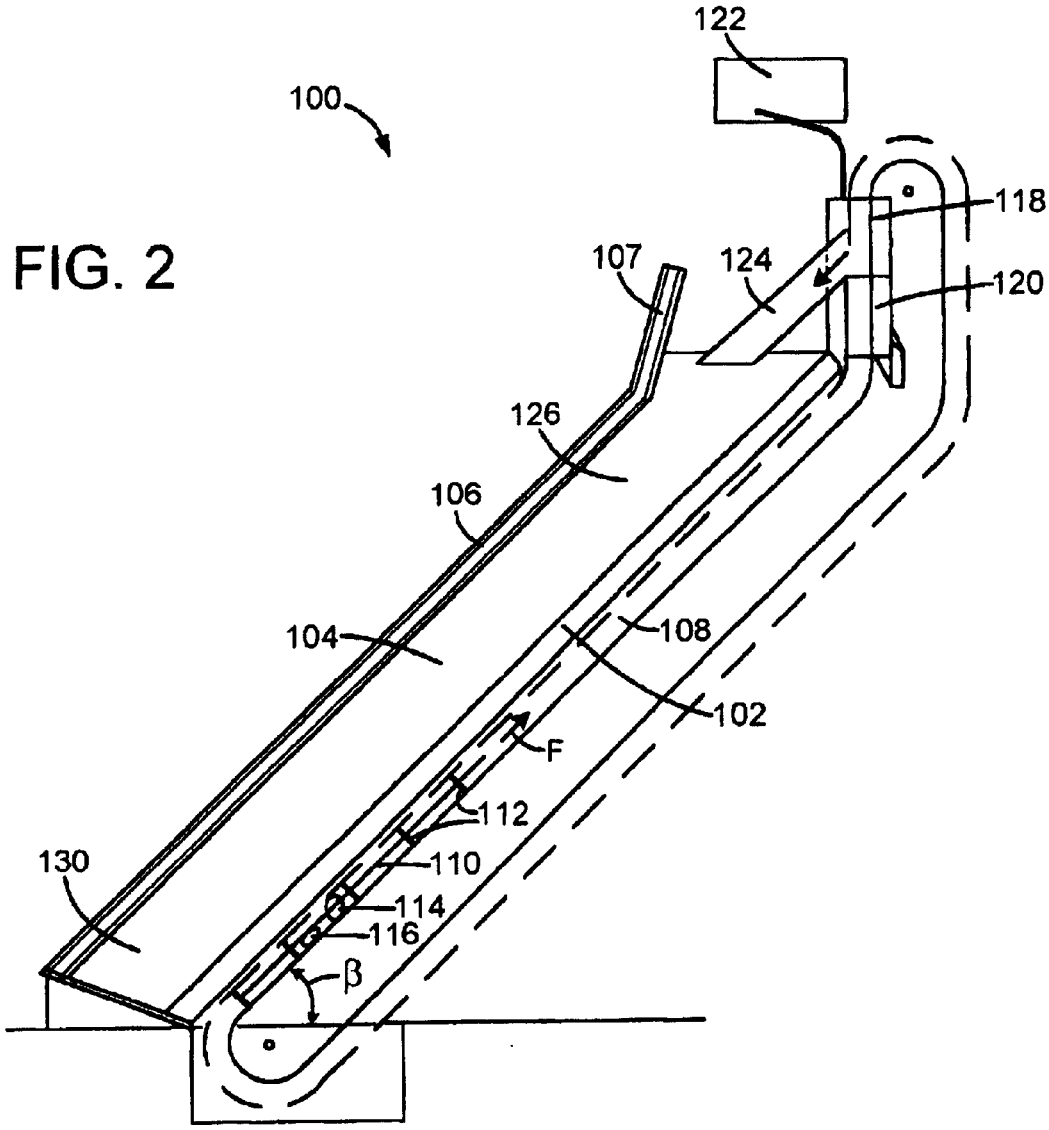
FIG. 2 is a side view of a second embodiment of the shooting range apparatus of the present invention.

FIG. 2 shows a shooting range apparatus 100 that has a support surface 102 that supports a free flowing granulate material 104 that is held to the support surface 102 by a resilient top layer 106. The layer 106 has an angled top end 107 to make it easier to fill the material 104 into the apparatus 100 as needed. The support surface 102 is angled at an angle beta that is greater than the angle of repose of granulate material 102. The support surface 102 has a channel 108 defined therein. The channel 108 has a movable cord 110 that has discs 112 attached thereto. The cord 110 may move upwardly, as shown by the arrow F, in the channel 108 and around the entire endless path of the channel 108. The discs 112 capture the granules 114 of granulate material 104 and captured projectiles 116 in the channel 108 to a lead separator 118 at an upper end 120 of the apparatus 100. A vacuum source 122 separates the granules 114 from the heavier projectiles 116 so that the granules 114 are diverted into a diverter 124 and fall into the cavity 126 formed between the top layer 106 and the surface 102. In this way, the projectiles 116 fall in a direction that is different from the granules 114. Also, it is possible to continuously empty or clean the free flowing granules 114 since the angle of repose is exceeded.

Figure 3:
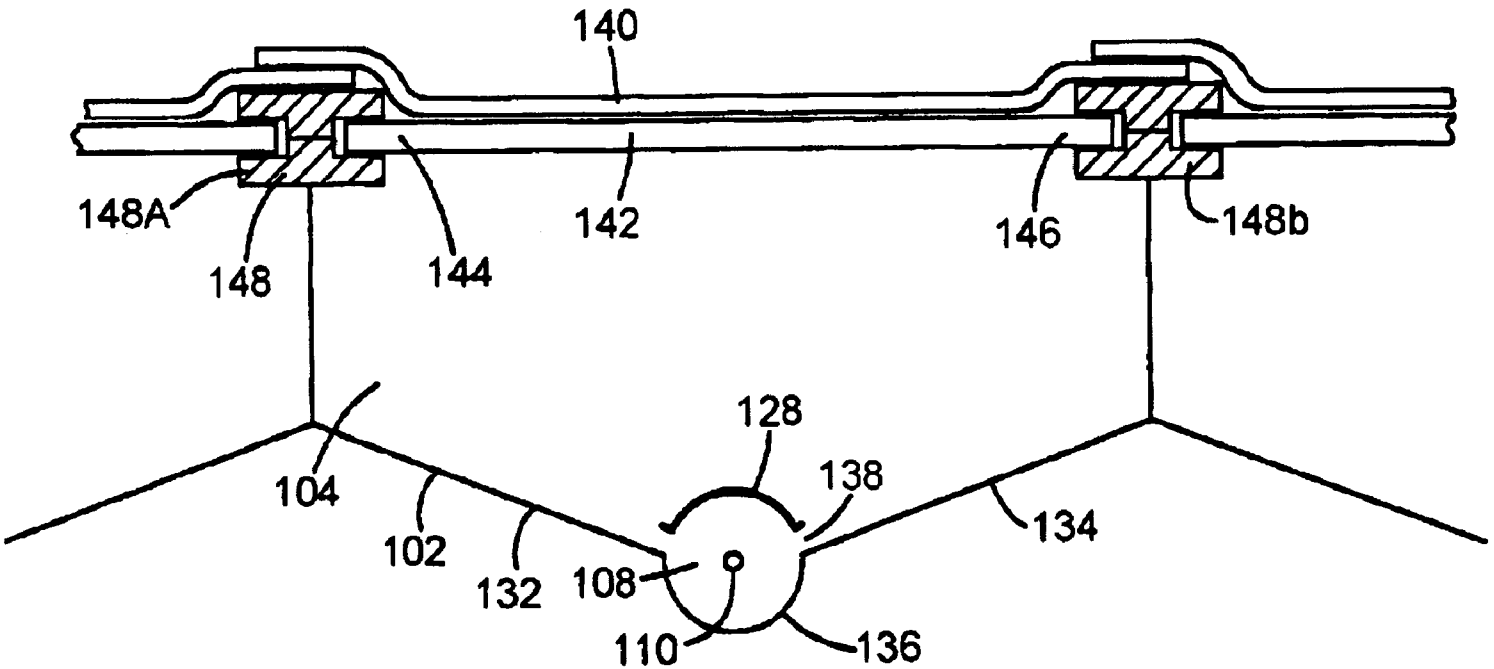
FIG. 3 is a detailed cross-sectional view of a portion of the apparatus shown in FIG. 2.

FIG. 3 is a detailed cross sectional view of the channel 108 and the top layer 106. The channel 108 is partly defined by a curved or straight/angled top protective cover 128 that extends from a bottom end 130 to the upper end 120 of the apparatus 100. The cover 128 prevents granulate material 104 from falling straight into the elongate cup 136. The support surface 102 has sloping sections 132 and 134 to that the channel 108 is disposed at a low point. The cover 128 and a cup shaped bottom 136 of the support surface 102 have a plurality of gaps 138 defined therebetween. The gaps or openings 138 are big enough to receive the granules 114 of granulate material 104 and the projectiles 116.

The top layer 106 has a rubber layer 140 placed on a plurality of stacked plastic rib or beam 142. It is also possible to remove the beams 142 when the angle is close to the angle of repose of the granulate material so there is an insignificant pressure on the layer 140. The ribs 142 have outer ends 144, 146 that are inserted into cavities formed in I-shaped profiles 148 that extend from the bottom 130 to the top end 120 of the apparatus 100. The ribs 142 are movable within the profiles 148 so that the ribs 142 may expand slightly due to the receipt of projectiles penetrating through the ribs. The rubber layer 140 reduces the risk of ricochets. It may also be possible to separate the ribs 142 so that there is a vertical distance between each rib 142. The. distance between each profile 148 may be about 1–1.2 meters. Preferably, the channel 108 is placed in the middle between, for example, a profile 148*a* and a profile 148*b*. It may also be possible to place the rubber layer 140 below the ribs 142 so that the layer 140 provides some support to the granulate material 104 when the ribs 142 are replaced to prevent the material 104 from flowing out of the structure 100 due to the steep sloping support angle beta.

Figure 4B:
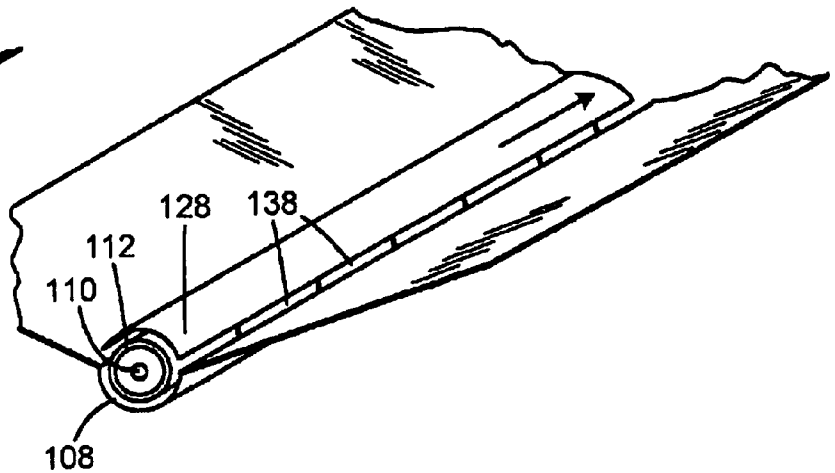
FIGS. 4*a*/4*b*/4*c* are detailed perspective views of channels of the apparatus of the apparatus shown FIG. 2.
Figure 4C:
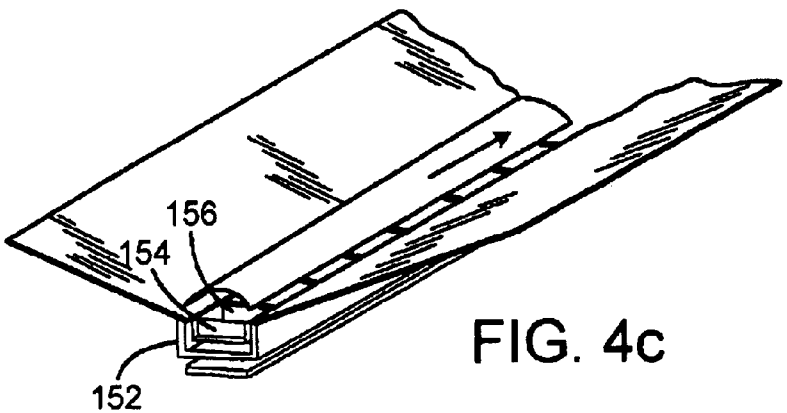
Figure 4A:
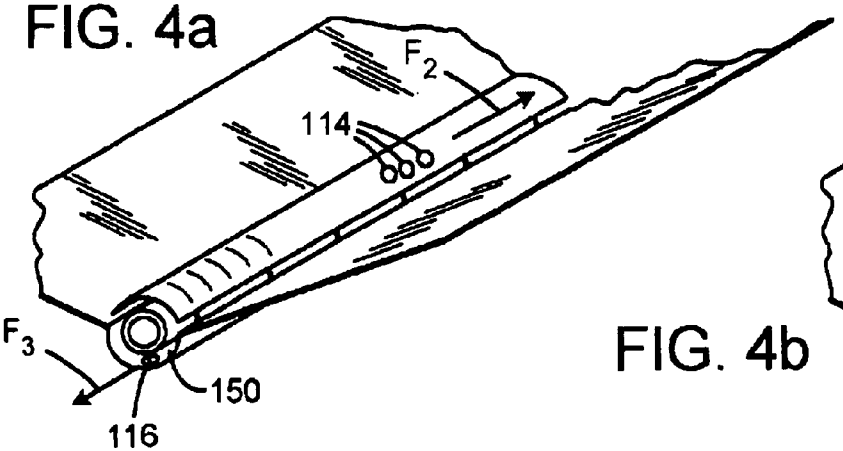

FIGS. 4*a*/4*b*/4*c* show a plurality of channel arrangements including the channels 108, 150, 152, respectively. As shown in the channel 150 of FIG. 4*a,* it is possible to apply a suction force F2 at an upper end of the channel 150 so that only the granules 114 are moved upwardly in the channel 150 while the projectiles 116 move downwardly due to the higher gravitational forces F3. It may also be possible to rotate to further separate the granules 114 from the projectiles 116. As shown in the channel 152 of FIG. 4*c,* a movable endless belt 154 with pockets 156 may be used to move the granules 114 and the projectiles 116.

Figure 5:
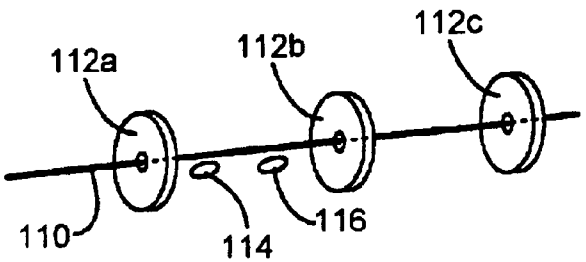
FIG. 5 is a detailed perspective view of the cord and discs disposed in the channel shown in FIG. 4*b;*
Figure 6:
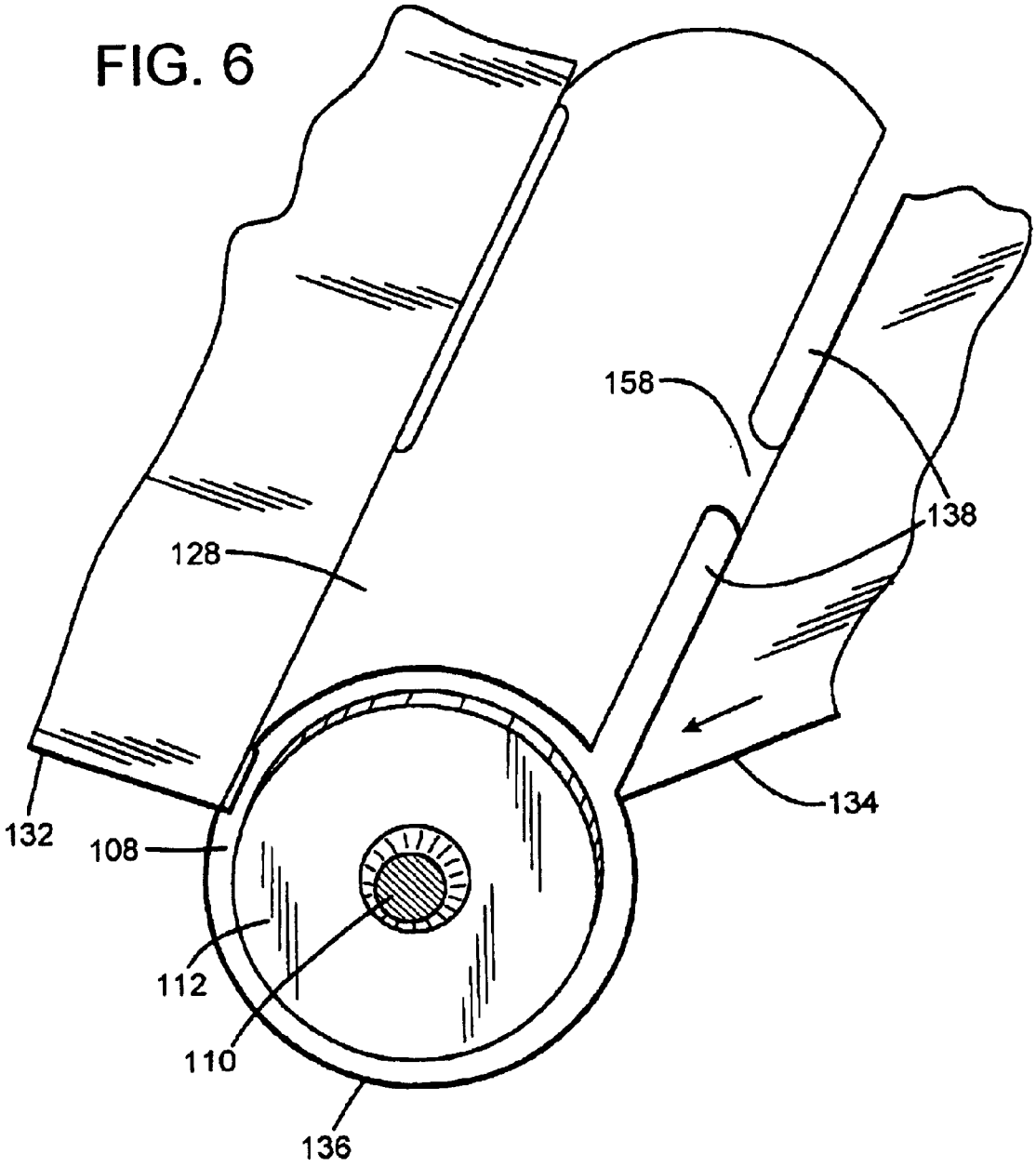
FIG. 6 is a detailed view of the channel shown in FIG. 4*b;*

FIG. 5 shows a detailed view of the cord 110 and the intermittently disposed discs 112*a,* 112*b,* 112*c* so that granules 114 of the granulate material 116 may be captured between the discs. FIG. 6 is a detailed perspective view of the cord 110 and the disc 112 disposed in the channel 108. Preferably, the gap 138 includes elongate slits that are separated by a support segment 158 that supports the curved segment 128.

FIG. 7 shows a third embodiment of a shooting range apparatus 200 of the present invention. The apparatus 200 has a housing 202 with a support surface 204 and a bottom 206 that forms an obtuse angle gamma with the surface 204. The housing 202 has a top layer 208 to hold a granulate material 210 to the housing 202. The top layer 208 is held to the support surface 204 by holding bands 212. The surface 204 forms an angle delta relative to a horizontal plane that is greater than the angle of repose of the material 210 to lower the pressure on the layer 208 compared to the support surface 204 being vertical. The layer 208 is also sloping at an angle that is greater than the angle of repose of the material 210.

FIG. 8 shows a fourth embodiment of a shooting range apparatus 300 of the present invention. The apparatus 300 is substantially similar to the apparatuses described above but it has an inclined support surface of tiles 302 that is sloping at an angle D that is greater than the granulate material disposed on the tiles 302. The apparatus 300 may include a support structure 304 and a support wall 306 disposed at a lower end of the apparatus. The apparatus 300 may have a bottom layer below the granulate material and a top layer that covers the granulate material, as described above. The apparatus 300 may have a drain pipe 308 extending at the bottom of the apparatus for draining purposes. One important advantage of the apparatus 300 is that it is inexpensive to build.

Figure 9:
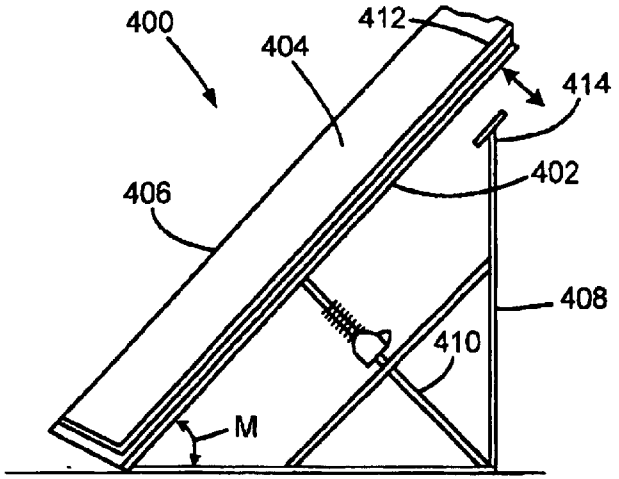
FIG. 9 is a side view of a fifth embodiment of the present invention.

FIG. 9 shows a fifth embodiment of a shooting range apparatus 400 in which the sloping angle is adjustable. Because the sloping surface 402 slopes at an angle (M) that is greater than or at the angle of repose of the granulated material 404, it is difficult to replace the resilient layer 406 that covers the granulated material 404 without causing the material 404 to fall from the surface 402. The support structure 408 has an adjustable length member 410 that extends towards the surface segment 402 perpendicularly. By extending the length of the member 410 the angle (M) is made steeper so that an upper end 412 of the surface segment 402 may be separated from an upper end 414 of the structure 408. Similarly, by reducing the length of the member 410 the angle (M) may be reduced to an angle that is less than the angle of repose of the material 404. In this way, the resilient layer 406 may be replaced or otherwise removed without causing the material for free flow off the surface 402. It may also be possible to support the surface segment 402 by a bent or curved foot so that the segment 402 may easily be raised or lowered, as desired.

Figure 10:
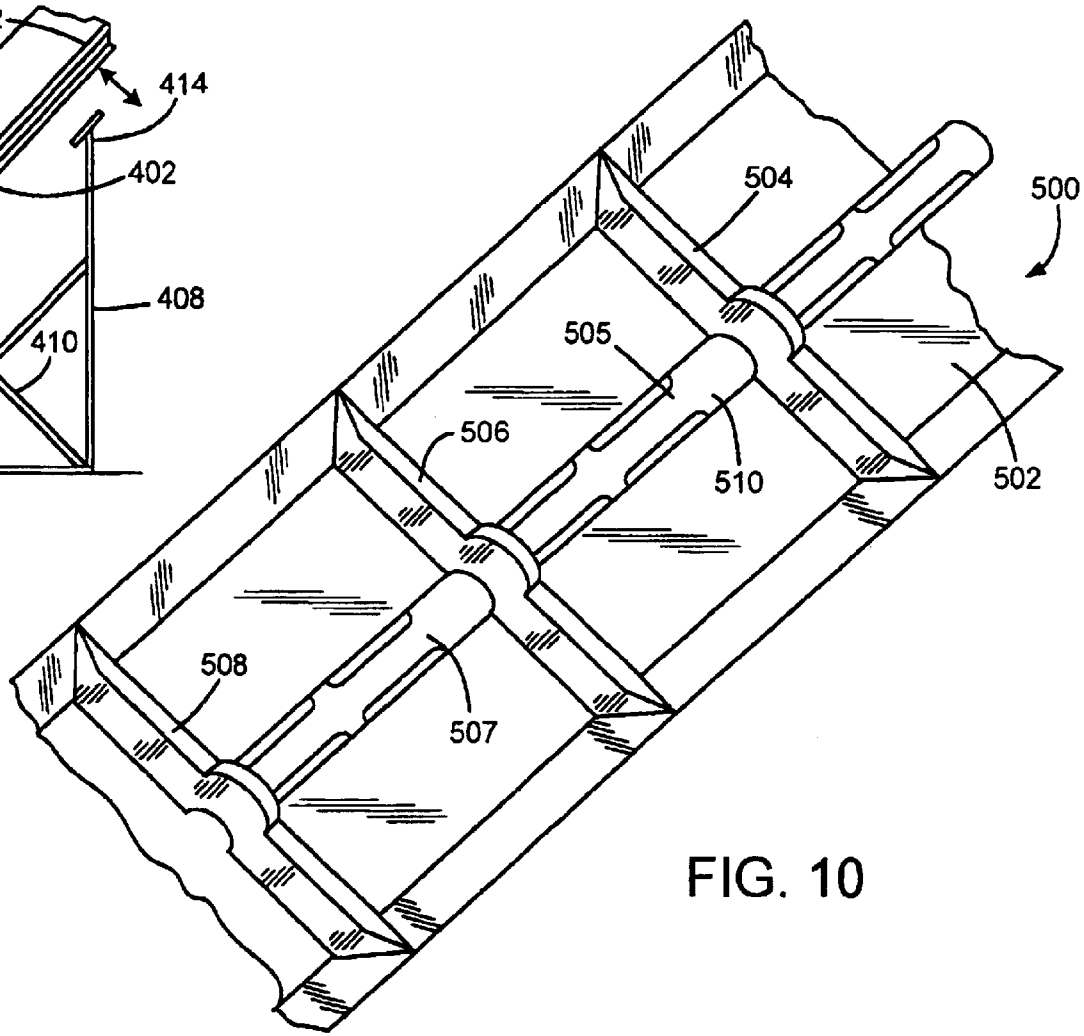
FIG. 10 is a detailed perspective view of a valve system of the present invention.

FIGS. 10–11 show detailed views a movable arrangement 500 disposed at a sloping surface segment 502. The arrangement 500 has wing members 504, 506, 508 that are attached to a central tube 510 so that the wing members are separated from one another along the tube 510. Only three wing members are shown for clarity. The tube 510 has a plurality of openings 512 defined therein. As best shown in FIG. 11, the tube 510 has a rotatable inner tube 514. The tube 514 has a plurality of openings 516 defined therein. The tube 514 is rotatable so that the openings 516 may be aligned with the openings 512 by turning the tube about 90 degrees or so. The tube 514 may be closed by turning the openings 516 away from the openings 512. In this way, projectiles 518 and granules 520 can only fall into the tube 514 when the openings 512, 516 are aligned. The openings 516 could be oriented differently in the section 505 of the tube 514 disposed between the wings 504, 506 compared to the section 507 between the wings 506, 508. In this way, the section 505 may be fully opened while the section 507 is closed or vice-versa.

Figure 13:
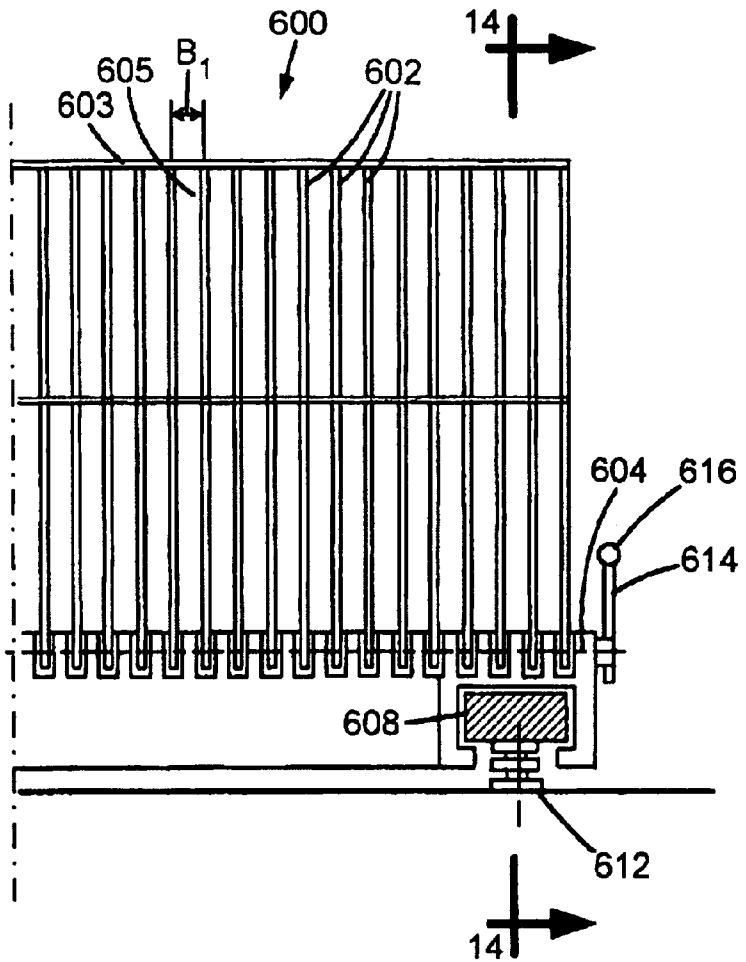
FIG. 13 is a side view of a projectile removing arrangement of the present invention.
Figure 14:
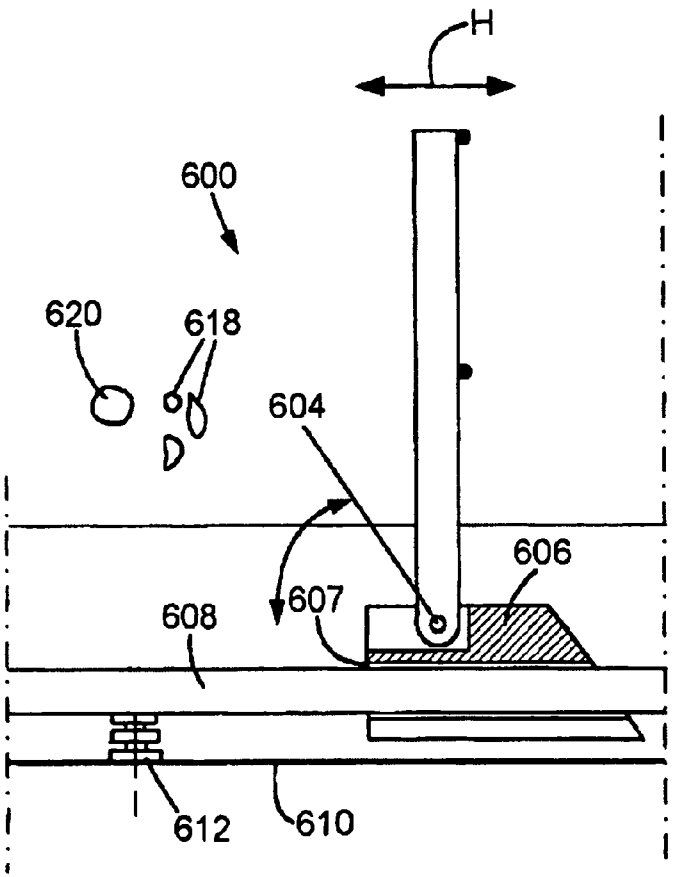
FIG. 14 is a cross-sectional view of the projectile removing arrangement along line 14—14 in FIG. 13.

FIGS. 12–14 show detailed views of a cleaning arrangement 600 that may, for example, substitute or complement the movable arrangement 500. The arrangement 600 has a plurality of parallel bars 602 that are rotatably attached to a horizontal arm 604. The arm 604 is attached to a carriage 606. The carriage 606 has a groove 607 defined therein that is slidable engaging a vibratable guide member 608 extending from a bottom to a top of a sloping surface 610. The guide member 608 is in operative engagement with a vibration dampening device 612. The bars 602 are movable between an upright position where the bars 602 are perpendicular to the sloping surface 610 and a horizontal position where the bars 602 are parallel to the sloping surface 610. On each end of the arm 604 there is an arm 614 that extends from the arm 604 to a guiding wire 616.

The distance B1 between each bar 602 of the bar structure 603 is preferably greater than a typical diameter, such as 2 mm, of the free-flowing granule particles 618 but smaller than a typical diameter, such as 5 mm or more, of a projectile 620. An important feature is that the size of the granule particles should be smaller than the smallest projectile size used so that the projectiles can be captured without removing the granules, as described below. When the bar structures 603 is raised to the vertical position, as shown in FIG. 13, and the carriage 606 moves along the guide member 608, as shown by the arrows H, the bars 602 capture the projectile 620 while the particles 618 are allowed to pass through the bar opening 605 so that only the projectiles are captured. Preferably, the carriages 608 should move slowly to permit the granule particles 618 to pass between the bars 602 and to take full effect of the vibration to separate the projectiles from the granule particles so that the projectiles 620 may fall off from an extension 622. Preferably, the arrangement is placed behind the bullet targets where likelihood of finding projectiles is high. It is also possible to lower the angle of the sloping surface to an angle below the angle of repose before the resilient top cover is removed and then insert the vibrating bar structure into the granule particles and slowly pull or push the arrangement to capture bullets disposed among the granules particles.

While the present invention has been described in accordance with preferred compositions and embodiments, it is to be understood that certain substitutions and alterations may be made thereto without departing from the spirit and scope of the following claims.

What is claimed is:

1. An apparatus for installation at shooting ranges, comprising:

a support structure having a sloping support surface;

a resilient top layer placed on top of a granulated material supported by the sloping support surface; and the sloping support surface and the resilient top layer sloping at an angle that is greater than an angle of repose of the granulated material.

2. The apparatus according to claim 1 wherein the top layer is held to the support structure by holding segments.

3. The apparatus according to claim 1 wherein the support surface has a channel defined therein, the channel extends from a bottom to a top of the sloping support surface and an endless moving arrangement is disposed in the channel for moving the granulated material upwardly in the channel.

4. The apparatus according to claim 1 wherein the granulate material has a thickness t1 at an upper end of the top layer and a thickness t2 at a lower end of the top layer and t2 is thicker than the t1.

5. The apparatus according to claim 1 wherein the apparatus has an openable emptying box at a lower end of the top layer.

6. The apparatus according to claim 3 wherein the channel has a movable cord disposed therein, the cord has a plurality of discs attached thereto.

7. The apparatus according to claim 3 wherein the channel terminates at a lead separator at an upper end of the apparatus.

8. The apparatus according to claim 7 wherein a vacuum source is disposed at the upper end of the apparatus for separating granules of the granulate material from projectiles.

9. The apparatus according to claim 3 wherein a top protective cover is disposed over the channel and extends from a bottom end to an upper end of the apparatus.

10. The apparatus according to claim 3 wherein the support structure has a V-shaped support surface with inwardly inclined sloping sections so that the channel is disposed at a low point between the sloping sections.

11. The apparatus according to claim 9 wherein the top protective cover has a gap defined therein for receiving granules of the granulate material and projectiles.

12. The apparatus according to claim 1 wherein the apparatus has I-shaped profiles extending from a bottom end to a top end of the apparatus.

13. The apparatus according to claim 12 wherein the I-shaped profiles have cavities defined therein and the apparatus has ribs 142 that extend into cavities.

* * * * *